US011795589B2

(12) United States Patent
Tremer et al.

(10) Patent No.: US 11,795,589 B2
(45) Date of Patent: Oct. 24, 2023

(54) RAPIER, METHOD FOR DRAWING IN A WEFT YARN WITH SUCH A RAPIER AND WEAVING LOOM COMPRISING SUCH A RAPIER

(71) Applicant: STAUBLI BAYREUTH GMBH, Bayreuth (DE)

(72) Inventors: Siegmund Horst Tremer, Glashuetten (DE); Elias Schmidek, Bayreuth (DE); Sergej Morokin, Bayreuth (DE); Michael Sigl, Ahorntal (DE)

(73) Assignee: STAUBLI BAYREUTH GMBH, Bayreuth (DE)

( * ) Notice: Subject to any disclaimer, the term of this patent is extended or adjusted under 35 U.S.C. 154(b) by 66 days.

(21) Appl. No.: 17/326,722

(22) Filed: May 21, 2021

(65) Prior Publication Data

US 2021/0372016 A1 Dec. 2, 2021

(30) Foreign Application Priority Data

May 26, 2020 (EP) ..... 20176598

(51) Int. Cl.
*D03D 47/27* (2006.01)
*D03D 41/00* (2006.01)

(52) U.S. Cl.
CPC ..... *D03D 47/273* (2013.01); *D03D 47/277* (2013.01)

(58) Field of Classification Search
CPC .... D03D 47/273; D03D 47/277; D03D 47/23; D03D 47/271; D03D 41/004;
(Continued)

(56) References Cited

U.S. PATENT DOCUMENTS 6,119,733 A * 9/2000 Arndt ..... D03D 47/38 139/194
6,164,342 A * 12/2000 De Jager ..... D03D 47/275 139/448

(Continued)

FOREIGN PATENT DOCUMENTS

CN 203498583 U * 3/2014 ..... D03D 47/23
CN 203498583 U 3/2014

(Continued)

OTHER PUBLICATIONS

European Search Report dated Oct. 20, 2020 for EP Application No. 20176598 filed May 26, 2020.

*Primary Examiner* — Robert H Muromoto, Jr.

(57) ABSTRACT

This rapier is for drawing-in a weft yarn into a shed of a weaving loom (2), along a drawing-in path. The rapier includes a rapier head (206) mounted at one end of the rapier, which extends along a main longitudinal is driven, along the drawing-in path, by a drive. Also included is a clamp (320) for catching a weft yarn, with the clamp being mounted in the rapier head, operable between an open and closed configuration. The rapier includes an electric motor, (208) mounted on the body for actuating the clamp and a mechanism (260-328) for transforming an output movement of the motor, which is a rotation around an axis (A208) parallel to the main longitudinal axis, into an opening or a closing movement of the clamp.

21 Claims, 9 Drawing Sheets

(58) Field of Classification Search
CPC ..... D03D 47/275; D03D 47/34; D03D 49/50; D03D 51/02; D03J 1/04
See application file for complete search history.

(56) References Cited

U.S. PATENT DOCUMENTS

| | | | | |
|---|---|---|---|---|
| 6,305,434 | B1 * | 10/2001 | Speich | D03D 47/20 139/448 |
| 7,721,768 | B2 * | 5/2010 | Iltis | D03C 3/12 139/21 |
| 2008/0236700 | A1 * | 10/2008 | Iltis | D03C 3/12 139/397 |
| 2021/0372016 | A1 * | 12/2021 | Tremer | D03D 47/23 |

FOREIGN PATENT DOCUMENTS

| | | | |
|---|---|---|---|
| EP | 1082478 | A1 | 3/2001 |
| EP | 1082478 | B1 | 7/2004 |
| EP | 2464768 | | 6/2012 |
| EP | 3121317 | A1 | 1/2017 |
| EP | 2464768 | B1 | 9/2017 |

* cited by examiner

RAPIER, METHOD FOR DRAWING IN A WEFT YARN WITH SUCH A RAPIER AND WEAVING LOOM COMPRISING SUCH A RAPIER

TECHNICAL FIELD OF THE INVENTION

The present invention concerns a rapier for drawing-in a weft yarn from a pick-up position into a shed of a weaving loom. This invention also concerns a method for drawing-in a weft yarn into a shed on a weaving loom and a weaving loom that incorporates, amongst others, such a rapier.

The technical field of the invention is the field of weaving of bi-dimensional or three-dimensional fabrics and, more particularly, the technical field of insertion means of weft yarns in the shed on a weaving loom.

BACKGROUND OF THE INVENTION

In the field of weaving, rapiers are used for inserting weft yarns through a shed. Most of the known systems catch the weft yarns by the mechanical action of a feeding gripper and a pick-up gripper, which collaborate with each other. The transfer of the weft yarn takes place roughly in the middle of the shed, with assistance of spring loaded means acting on the weft extremity. Alternatively, the gripper opening might be controlled from outside the shed, by operating elements, which are complicated to implement in the environment of a weaving loom.

In the domain of weaving of reinforced fabrics, where the weft yarns to be drawn into the shed can be formed of bands or cylindrical yarns of Carbon, Kevlar or similar materials, the situation is more compelling than for the insertion of cotton weft yarns, since the weft yarns are fragile, cannot be twisted and may be of a variable thickness, smoothness or width. Traditional weft insertion systems are not satisfactory and would not be reliable in this domain.

EP-A-1 082 478 discloses a rapier with a clamp including a mobile jaw, movable with respect to a stationary jaw under the action of an electromagnetic actuator and under the action of a spring. Such an approach does not allow precisely controlling the clamping force exerted on the weft yarn, which may result in damages to the weft yarn. Moreover, the electromagnetic actuator is bulky and fragile. With this known device, a feed rapier operates with a pick-up rapier, so that the weft transfer occurs in the center of a shed. The feed rapier may damage, cut or twist the weft yarn because of its oscillating motion. Finally, catching the weft yarn with a movable clamping portion and a stationary clamping surface is neither reliable nor accurate particularly because the stationary clamping surface can hit the weft yarn or change its positioning before clamping.

On the other hand, it is known from EP-A-2 464 768 to use a gripper head with a clamping device for a band shaped weft material, where an actuator moves a movable clamping part with respect to a fixed clamping part. A spring forces the clamp to close and the actuator must act against the spring force. It is thus difficult to control and monitor the clamping force exerted on the weft yarn. In addition, adjustment of the spring force is manual, which is cumbersome.

Finally, it is known from CN-U-203 498 583 to use a piston to drive a screw rod, in order to actuate some jaws of a chuck member. Control of the jaws movement is not precise.

SUMMARY OF THE INVENTION

This invention aims at solving the above-listed problems by providing a new rapier which is versatile, insofar as it is compatible with many weft yarn types, including reinforced weft yarns, this rapier allowing an efficient control of the clamping force exerted on the weft yarn and possibly adjustment of this clamping force. This prevents damages on the weft yarn and allows releasing different kind of weft yarns anywhere along a drawing-in path. This invention also provides a light rapier head, which allows moving this rapier at high speed.

To this end, the invention concerns a rapier for drawing-in a weft yarn from a pick-up position into a shed of a weaving loom, along a drawing-in path, the rapier including

- a rapier head mounted at one end of the rapier, said rapier head extending along a main longitudinal axis of the rapier and being driven, along the drawing-in path, by a drive;
- a clamp for catching a weft yarn, said clamp being mounted in the rapier head and being operable between an open configuration and a closed configuration;
- an actuator mounted on the rapier for actuating the clamp; and
- a movement transforming mechanism for transforming an output movement of the actuator into an opening or a closing movement of the clamp, According to the invention, the actuator is an electric motor and the output movement of the motor is a rotation around a rotation axis parallel to the main longitudinal axis of the rapier.

In the meaning of the invention, a warp yarn can be of any known type, with a circular, oval or rectangular cross-section with rounded edges, and made of any material, in particular a relatively rigid material, such as carbon, glass, ceramic, aramid or Kevlar. When the warp yarn has a rectangular cross or oval-like cross section, it can also be named a ribbon, a tape or a band.

Owing to the invention, the electric motor can be used to transmit, via the movement transforming mechanism, a precisely defined clamping force. Thus, the clamp is precisely controlled in order to efficiently catch a weft yarn, even a reinforced or fragile weft yarn, without damages to the yarn. Moreover, the physical arrangement of the electric motor in the rapier head is such that the rapier head is very compact. This allows the rapier head moving in a relatively small shed, at high speed.

According to advantageous optional aspects of the invention, such a rapier may incorporate one or several of the following features, considered in any technically allowable configuration:

- The movement transforming mechanism is configured to operate the clamp from its closed configuration to its open configuration when an output shaft of the electric motor rotates in a first direction around the rotation axis and to operate the clamp from its open configuration to its closed configuration when the output shaft of the electric motor rotates in a second direction, opposite to the first direction, around the rotation axis. Thanks to this aspect of the invention, the rapier clamp is active without a spring and it can be programmed in two directions, namely opening and closing, with dynamic parameters.
- The movement transforming mechanism includes a slider movable in translation along a direction parallel to the main longitudinal axis, between a first longitudinal position and a second longitudinal position, said slider being configured to operate the clamp from its closed configuration to its open configuration, when the slider moves from its first longitudinal position to its second longitudinal position, and to operate the clamp from its open configuration to its closed configuration, when the slider moves from its second longitudinal position to its first longitudinal position. Thanks to this aspect of the invention, the slider can be integrated in the rapier head and the forward position of the slider is favorable for applying a force at the nose of the clamp, that is at its forward end.

The slider includes a set of two plates which extend parallel to the main longitudinal axis, on two lateral sides of this axis, each plate including first and second sliding surfaces, separated from each other along the main longitudinal axis and configured to slide along corresponding guiding surfaces provided on a frame of the rapier head. Thanks to this aspect of the invention, the two plates avoid oscillations of the clamp around the longitudinal axis and the slide can be relatively long, thus stable and reliable. The two separated sliding surfaces of the plates are compatible with a movement within a frame where one or several bosses define a rotation axis for a part of the clamp. A screw-nut sub-assembly of the movement transforming mechanism is efficiently guided by the two plates, which is favorable for the life span of the electric motor.

The clamp includes two jaws, with at least a first jaw articulated with respect to a frame of the rapier head, around a pivot axis perpendicular to the main longitudinal axis, wherein the first jaw extends, along the longitudinal axis at least between the pivot axis and a jaw-end configured to catch, in cooperation with the other jaw of the clamp, a weft yarn to be drawn into the shed and wherein, preferably, the jaw-end is a clamping edge perpendicular to the main longitudinal axis. An articulated jaw provides a good positioning precision, thus a good precision in the clamping force exerted on the weft yarn. In addition, when the jaw end defines a clamping edge, it provides a perpendicular contact line on the full width of the weft yarn, which is reliable for any kind and size of weft yarn.

The clamp includes a first jaw articulated with respect to the frame of the rapier head, around a first pivot axis perpendicular to the main longitudinal axis, and a second jaw articulated with respect to the frame of the rapier head, around a second pivot axis perpendicular to the main longitudinal axis and the first and second pivot axes are parallel and/or superimposed. Thanks to this aspect of the invention, the two jaws move faster towards each other than if there were only one movable jaw. Since the two jaws can be guided on their full width, their parallelism is well controlled.

The first and second jaws extend symmetrically on either sides of the main longitudinal axis and the movement transforming mechanism exerts opposite forces on the first and second jaws, for pivoting the first and second jaws toward or away from each other with respect to the main longitudinal axis. Thanks to this aspect of the invention, the yarns are reliably caught at the pickup position where a weft yarn extremity is presented, and remain reliably clamped during the drawing-in process.

The first jaw is provided with a groove and the slider is equipped with a follower member engaged in the groove of the first jaw, or the slider is provided with a groove and the first jaw is equipped with a follower member engaged in the groove of the slider, and the groove is configured for guiding the follower member engaged in the groove and configured for converting a translation movement of the slider, parallel to the main longitudinal axis, into a pivoting movement of the first jaw. This structure of the rapier provides a reliable mechanical connection between the slider and the jaws. The contact zone formed between the slider and each jaw can be a contact line. Thus, the motion of the movable jaw or of each jaw is accurate, without twisting. There is no need to apply a strong clamping force to guarantee an efficient catching of the weft yarn. The output torque of the electric motor can be adapted, which reduces the risks of cutting the weft yarn end.

The groove has a curved profile extending between a first end and a second end; when the follower member is at the first end, the clamp is in its open configuration; when the follower member is at the second end, the clamp is in its closed configuration and the second end of the profile extends at a distance, measured parallel to the main longitudinal axis, equal to less than 35%, preferably about 25%, of a distance measured, along the main longitudinal axis, between the pivot axis and the jaw-end. Thanks to this aspect of the invention, an acceleration curve of the movable jaw(s) can be adapted to the needs. With relatively long jaws, cams and sliders, an accurate and reliable movement can be obtained, which allows accelerating the movement of the jaws, with respect to each other. Thanks to this aspect of the invention, the force applied to the jaws for closing the clamp is applied close to the jaw end, so that the bending of the jaws is minimized, and the dynamic response of the movement transforming mechanism is direct and fast.

The slider is equipped with a nut, integral or fixed in rotation with the first slider, and the electric motor is equipped with a threaded rod engaged in the nut. Alternatively, the electric motor is equipped with a nut, integral or fixed in rotation with the electric motor, and the slider is equipped with a threaded rod engaged in the nut. In both cases, the rotation movement of an output shaft of the electric motor is converted into a translation movement of the slider. The screw-nut assembly allows a reduction of the output movement of the electric motor and a possible adaptation of the torque.

The rapier includes a position encoder, for measuring a geometric parameter relative to the opening of the clamp, and/or a torque controller for measuring a torque delivered by the electric motor. The position encoder and/or torque sensor allows adapting the clamping force of the jaws on the basis of the information collected by this sensor.

According to another aspect of the invention, the invention also concerns a method for drawing-in a weft yarn on a shed on a weaving loom, which comprises a warp delivery unit;

heddles for moving the warp yarns in order to form a shed;

a shed forming mechanism, which moves the heddles;

weft bobbins, which provide weft yarns to the loom; and a rapier for drawing-in a weft yarn from a pick-up position into the shed, along a drawing-in path, the method including at least the following steps consisting in:

a) catching the weft yarn at the pick-up position;

b) drawing the weft yarn into the shed, to a predetermined position along the drawing-in path;

c) releasing the weft yarn at the predetermined position; and d) withdrawing the rapier from the predetermined position (P3) out of the shed.

According to the invention, the method is implemented with a rapier as mentioned here-above and at least one of a geometric parameter representative of the opening of the clamp and a parameter representative of the clamping force, is measured during at least one of steps a), b) or d), and the value of the measured parameter is compared to a threshold value or two values of the parameter measured during two different steps are compared to each other.

Owing to the method of the invention, the presence and the thickness of the weft yarn can be checked during the drawing-in movement of the rapier. Advantageously, no outer piece of equipment, like a camera or a sensor, is complementary needed to monitor the wet yarn in the closed environment of the weaving loom, where the shed is dense, the yarns are fragile, and neither the rapier nor the weft yarn are visible enough to be monitored from the outside.

According to advantageous optional aspects of the invention, such a method may incorporate one or several of the following features, considered in any technically allowable configuration:

- The geometric parameter representative of the opening of the clamp or the parameter representative of the clamping force is measured, respectively, through the electric motor as an angular position of an output shaft of the electric motor around the rotation axis, or measured as a physical value proportional to the torque applied by the electric motor to the clamp.
- The clamp is brought to its open configuration at step c), during step d), sub-steps are implemented, which consists in
  - d1)—operating (Φ5) the clamp from its open configuration to its closed configuration and
  - d2)—measuring the geometric parameter (θ) representative of the opening of the clamp in the closed configuration, and
  - the geometric parameter measured in at least one of steps a), b) or d) and compared to the threshold value is the geometric parameter measured at sub-step d2) or
  - the two values of the geometric parameter (θ) measured during two different steps include the value measured at sub-step d2).
- A value of the geometric parameter representative of the opening of the clamp measured during step b) is compared to a value of the same geometric parameter measured during sub-step d1).
- A clamping force exerted by the clamp in its closed configuration or an angle between the two jaws of the clamp at the pickup position is adaptable between two successive picks, as a function of a parameter dependent on the weft yarn properties or as a function of an external parameter and the clamping force or the opening of the clamp is measured through the electric motor during step a). This aspect of the method of the invention allows adapting the action of the clamp on the weft yarn to the weft material inserted at each pick.

According to still another aspect of the invention, the invention also relates to a weaving loom for weaving a fabric with warp yarns and in woven weft yarns, this weaving loom comprising a warp delivery unit, heddles for moving the warp yarns in order to form a shed, a shed forming mechanism which moves the heddles, weft bobbins which provide weft yarns to the loom and a rapier for drawing a weft yarn from a pick-up position into the shed, along a drawing-in path.

According to this aspect of the invention, the rapier is as mentioned here-above and includes an embedded control unit in communication with the control unit of the weaving loom, whereas the embedded control unit controls the electric motor of the rapier on the basis of data provided by the control unit of the weaving loom.

BRIEF DESCRIPTION OF THE DRAWINGS

The invention will be better understood and other advantages thereof will appear more clearly, upon reading of the following description of two embodiments of a rapier, of a weaving method and of a weaving loom according to the invention, this description being provided solely as an example and made in reference to the appended drawings, in which.

DETAILED DESCRIPTION OF SOME EMBODIMENTS

Figure 1:
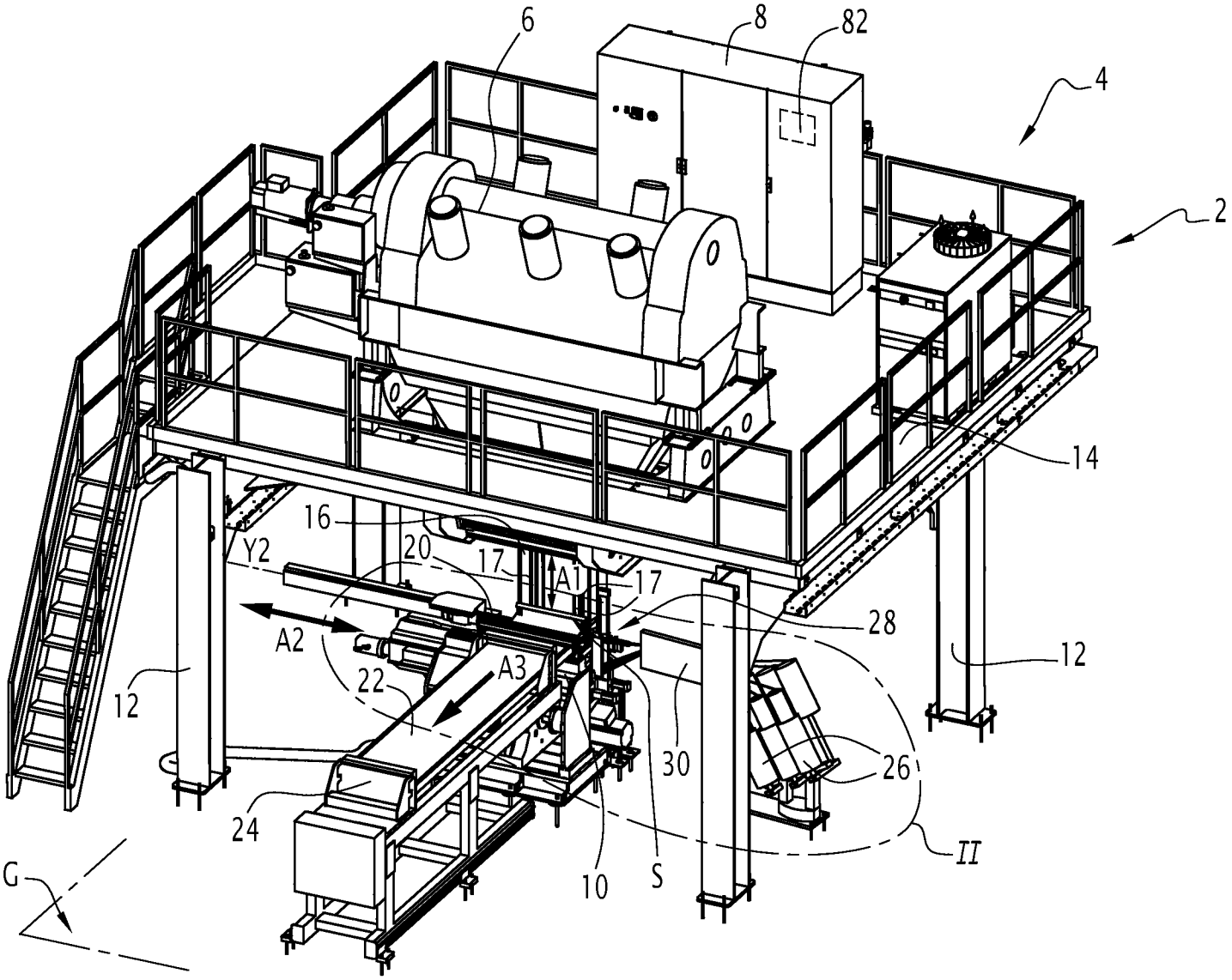
FIG. 1 is a schematic perspective view of a weaving loom according to the invention.

The weaving loom 2 represented of FIG. 1 includes a gantry 4, which supports a Jacquard machine 6 and some control cabinets 8 above a weaving machine 10 fixed on the ground G. The gantry 4 has several posts 12 also fixed on the ground, which support together a platform 14, where the Jacquard machine 6 and the control cabinets 8 are located.

A harness 16, made of heddles 17 and non-represented cords, is vertically movable to form a represented shed S, at the level of the weaving machine 10, with warp yarns 18 coming from a non-represented creel.

The alternative vertical movement of the harness cords and heddles 17 is represented by double arrow A1 on FIG. 1.

A rapier 20 is used for inserting weft yarns 34 into the shed in order to weave a fabric 22. On FIGS. 1 to 3, double arrow A2 represents the alternative horizontal movement of the rapier 20 along a weft insertion axis Y20, when it is guided by a rail 201 of a rapier unit 200. This rapier unit 200 forms a weft insertion mechanism and also includes a drive 203 for moving back and forth the rapier 20 along the weft insertion axis Y20.

Figure 2:
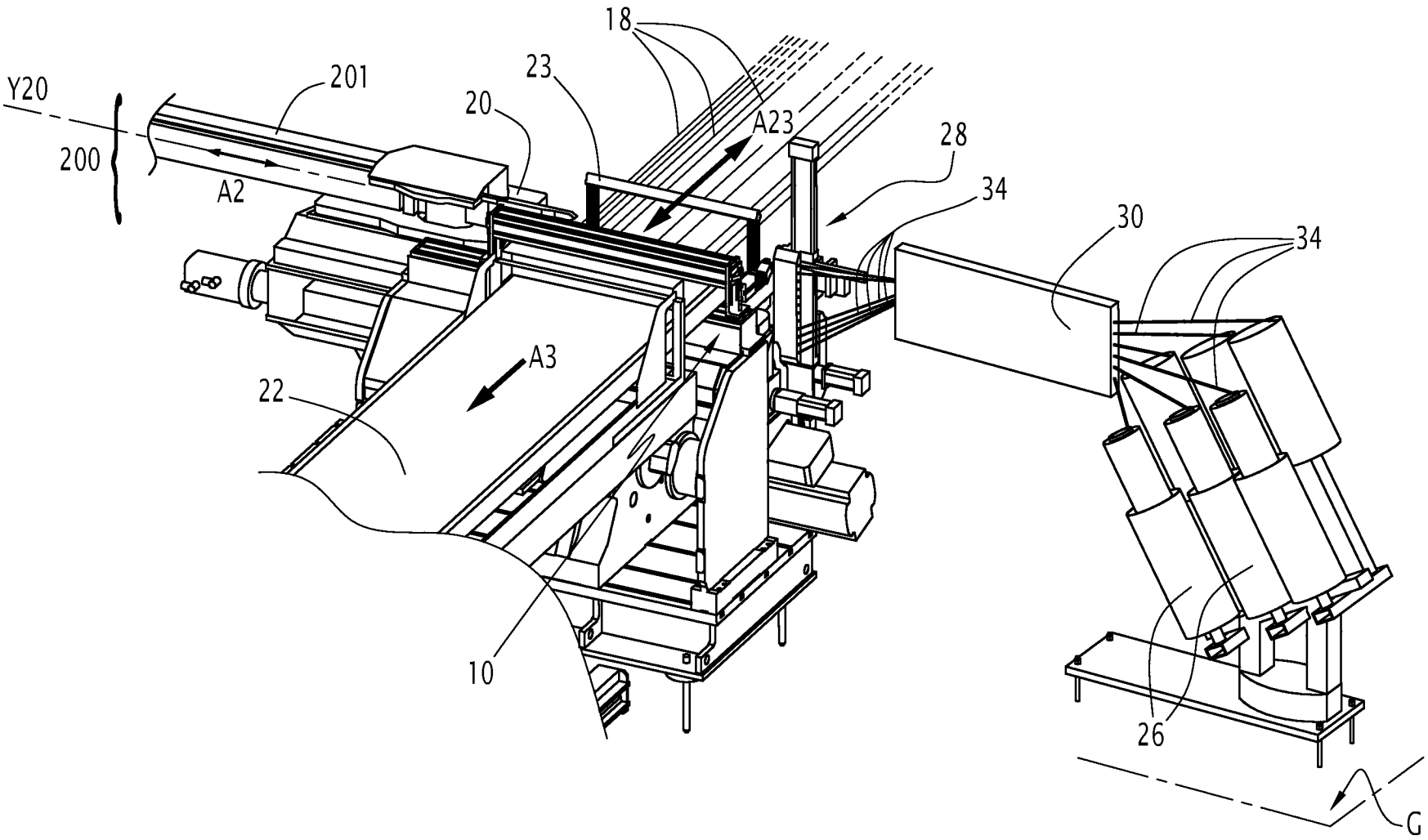
FIG. 2 is an enlarged view of detail II on FIG. 1, whereas the harness of the loom has been omitted for the sake of simplicity.

On FIG. 2, arrow A3 represents the unidirectional displacement of the woven fabric 22 towards a take-up carriage 24.

A reed 23 is used for beating the weft yarns 34 into the fabric 22 after each pick. Double arrow A23 represents the beating movement of the reed on FIG. 2.

The weft yarns 34 unwind from bobbins 26 located next to the weaving machine 10 and are presented to the rapier 20 by a weft selector 28 fed from the bobbins via a compensator 30, known per se and designed to avoid shaking in the supply of weft yarns. The compensator 30 guarantees a substantially constant tension of the weft yarns 34 leaving this compensator.

In the example of the figures, six bobbins 26 are mounted on a support bracket 32 fixed on the ground G, next to weft selector 28 and to the compensator 30. The weft selector 28 can be fed with weft yarns coming from up to twelve bobbins 26. The number of bobbins 26 can be increased, in order to match the number of different weft yarns to be used in the weaving loom 2.

In this example, the warp yarns 18 are made from polyester, polyamide or other relatively cheap thermoplastic material. Alternatively, these warp yarns can be made from glass, carbon or another more elaborated material for generating three dimensional technical multilayer fabrics, for instance for a blade of a propeller, or two dimensional multilayer fabrics, which might be cut and assembled together through a laying-up process, for instance to shape a technical part of an automotive.

The weft yarns 34 a made from reinforced plastics or from fibers, such as carbon, Kevlar, ceramic, aramid or glass. As mentioned here above, these yarns can have a circular, oval, rectangular cross section, or an approximatively rectangular cross section with rounded edges. They can form circular yarns, tapes, bands or ribbons, with a width between 0.014 mm and 5 mm.

The rapier 20 includes a rapier rod 202 made of metal and which extends a main longitudinal axis A20 of the rapier 20. This rod 202 is provided with a succession of teeth which together form a rack 202*a* in meshing engagement with a drive wheel 203*a* of the drive 203. Thus, a rotation of the drive wheel 203*a* around a vertical axis Z203, as shown by arrow A203 on FIG. 3, induces a displacement of the rapier 20 along the weft insertion axis Y20, as shown by double arrow A2.

A rapier body 204 is rigidly mounted at one end of the rapier rod 202 by an assembly mechanism 205 which includes a bracket 205*a* and some screws 205*b*. In this example, the rapier body 204 includes an armature 204*a* formed by a rigid metallic plate and an adapter-block 204*b* rigidly mounted on the armature. The armature is elongated, with its longest dimension parallel to the main longitudinal axis A20. Thus, the rapier body 204 is also elongated and extends along this main longitudinal axis. Thanks to the rigid connection between parts 204 and 202, the rapier body 204 is driven along the drawing-in axis Y20 by the rapier rod 202 driven by the drive wheel 203*a*.

A non-represented cover belongs to the rapier body 204 and is configured for being mounted on the parts 204*a* and 204*b*.

The rapier rod 202 is made of a rigid metallic part. Alternatively, this rapier rod can be replaced by a rapier band, made of a semi-rigid plastic, also provided with a rack configured for cooperating with the drive wheel 203*a*.

Figure 4:
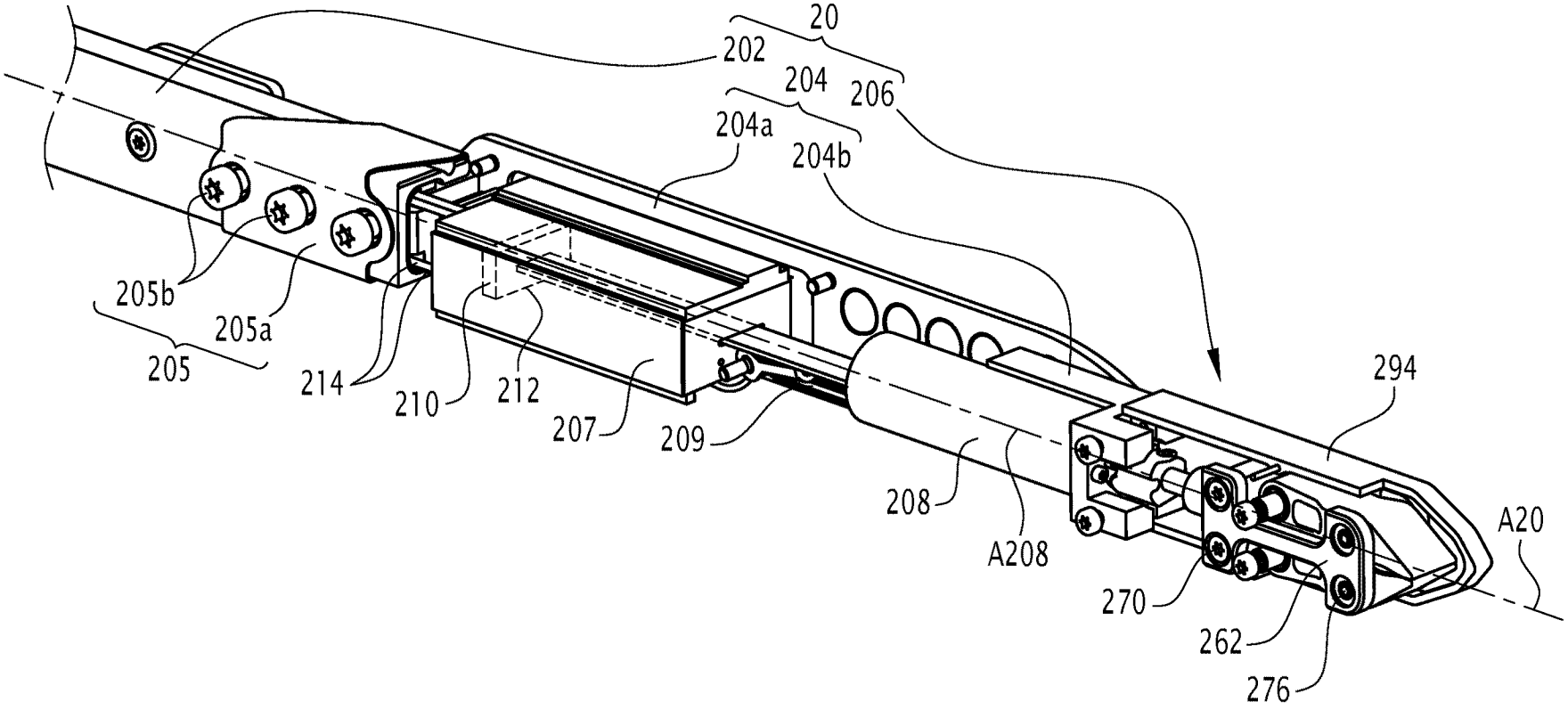
FIG. 4 is a perspective view of one extremity of the rapier of FIG. 3, on the side of its head, where a part of a frame of the rapier head has been omitted for the sake of clarity.
Figure 7:
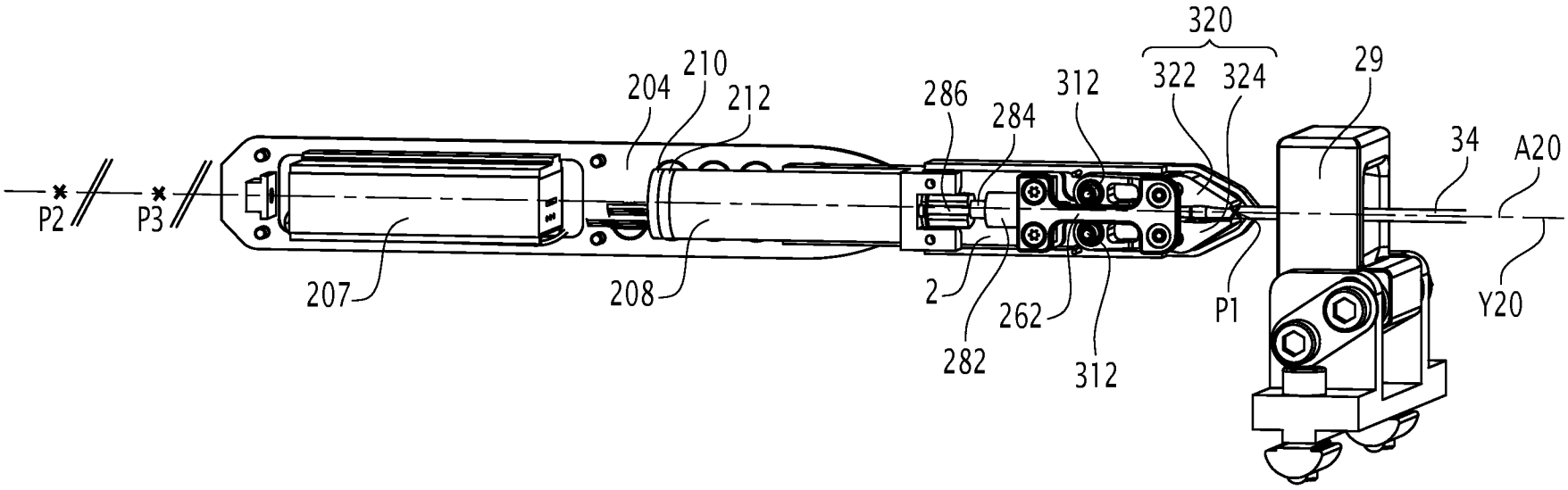
FIG. 7 is a schematic perspective view of the forward end of the rapier and some components of its environment.

An electronic control unit, or ECU, 207 is embedded in the rapier 20, more precisely mounted on the rapier body 204. An electric motor 208 is mounted on the adapter-block 204*b*, with its output shaft 208*a* oriented opposite to the ECU 207. A208 denotes the longitudinal axis of the output shaft 208*a*, which is also its axis of rotation. In order to show the output shaft 208A, the motor 208 is represented offset, along the longitudinal axis A20, from the adapter block 204*b* on FIG. 5. Its normal position is as shown on FIGS. 4 and 7.

The longitudinal axis A208 is aligned on the longitudinal axis A20. In other words, the output movement of the electric motor 208 is a rotation movement around axis A208, which is parallel to and superimposed with the longitudinal axis A20. Alternatively, the longitudinal axis A208 of the output shaft 208*a* and the main longitudinal axis A20 of the rapier 20 can be offset, and parallel. In such a case, the output movement of the motor 28 is a rotation around a rotation axis A208 which is parallel to, but not superimposed with, the main longitudinal axis A20 of the rapier 20.

In practice, the electric motor 208 is servomotor, more precisely, a brushless DC motor.

The ECU 207 and the electric motor 208 are connected to each other by electrical wires 209. A position encoder 210 is integrated into the electric motor 208 and allows measuring the angular position of the output shaft 208*a* around the rotation axis A208, that is the opening of the clamp 320, or its rotational speed. Alternatively, the position encoder can be assembled with the electric motor 208. A torque sensor 212 is also included in rapier 20, at the rear of the position encoder 210, and measures the instantaneous value of the current which is representative of the torque $T_{mot}$ delivered to the motor 208. Alternatively, a torque controller is included in the ECU 207 and can detect the mechanical torque of the motor 208. Electrical wires 209 allow providing electric motor 208 with electrical power and transferring data from encoder 210 to the ECU 207.

The ECU 207 is connected by respective electrical wires 214 to a cable connector 216. Between the ECU and a cable connector 216, the electrical wires 214 circulate in the rail 201 and a in a cable drag-chain 220.

The cable connector 216 is connected by a first electrical line 222 to a power source 224 which provides electrical power for actuating the electric motor 208 through the control unit 207. The cable connector 216 is also connected, via a data line or bus 226, to a main control unit or main ECU 82 which, in this example, is installed in one of the cabinets 8, as visible on FIG. 1.

This main ECU 82 communicates with a memory 84 where programs P are loaded for piloting different parts of the weaving loom 2 according to a predetermined pattern.

Alternatively, the memory 84 can be part of the main ECU 82.

The main ECU 82 is connected by respective buses 228 to controlled pieces of equipment of the weaving loom 2, such as the drive 203, the reed 23 and the take-up carriage 24.

Figure 3:
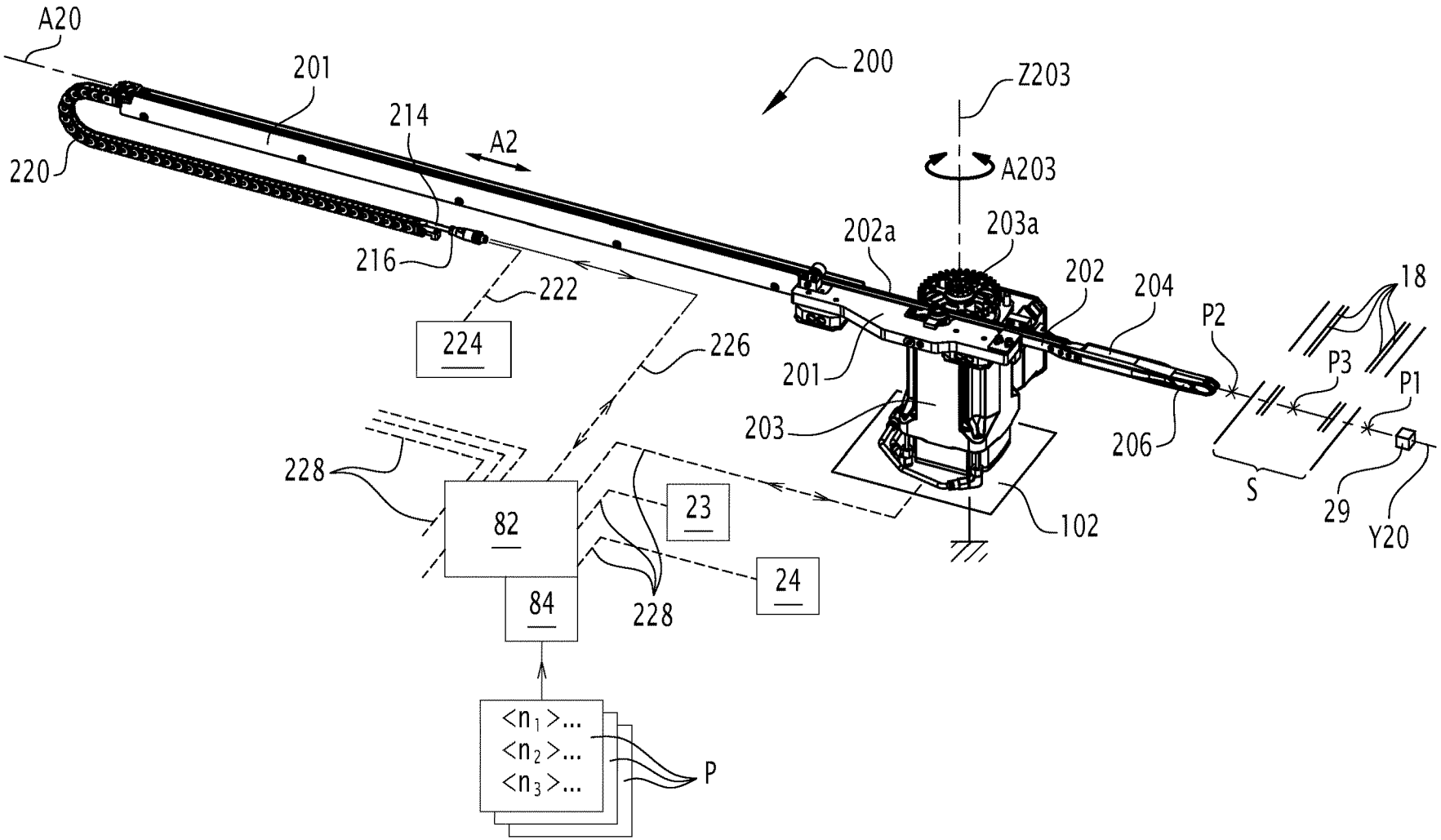
FIG. 3 is a schematic perspective view of the rapier of the weaving loom of FIGS. 1 and 2 and some components of its environment.

As shown by double arrows on FIG. 3, the data lines or buses 226 and 228 allow bidirectional communication, so that the main ECU 82 can pilot the respective pieces of equipment according to the selected program P and obtain a feedback of the actual working conditions and parameters of these pieces of equipment.

In particular, the main ECU 82 provides, via the data line or bus 226 and electrical wires 214, some data to the embedded in the ECU 207 for controlling the electric motor 208 depending on the selected program P and depending on the position of the heddles 17.

A rapier head 206 is mounted at one end of the rapier 20 and belongs to this rapier. The rapier body is interposed between the rapier rod 202 and the rapier head 206 along the main longitudinal axis A20.

The structure of the rapier head 206 will now be described.

The rapier head 206 includes a slider 260 made of two rigid plates 262 and 264 and a nut 266, all preferably made of a synthetic material, such as plastics, in particular PEEK. Each plate 262 or 264 is provided with beveled holes 268 for receiving respective screws 270 threaded into corresponding threaded holes 272 of the nut 266. This allows constituting the slider 260 by securing the two plates 262 and 264 on the nut 266 relative to the axis A20. With this construction, the slider 260 is rigid and can reliably move along a direction parallel to axis A20, as explained here below.

Each plate 262 or 264 is also provided with two cylindrical holes 274, each of these holes accommodating a cam cylinder 276. In total, the rapier head 206 includes four cam cylinders, two on each plate 262 or 264. The two cam cylinders 276 mounted in the upper cylindrical holes 274 of the two plates 262 and 264 are aligned on a first axis A276. Similarly, the two cam cylinders 276 mounted in the lower cylindrical holes 274 of the two plates 262 and 264 are aligned on a second axis or A'276. The axes A276 and A'276 are perpendicular to the main longitudinal axis A20 and offset along a direction perpendicular to this axis, here a vertical direction. A camshaft 278 extends between each pair of two cam cylinders 276 aligned on the same axis, A276 or A'276.

Figure 5:
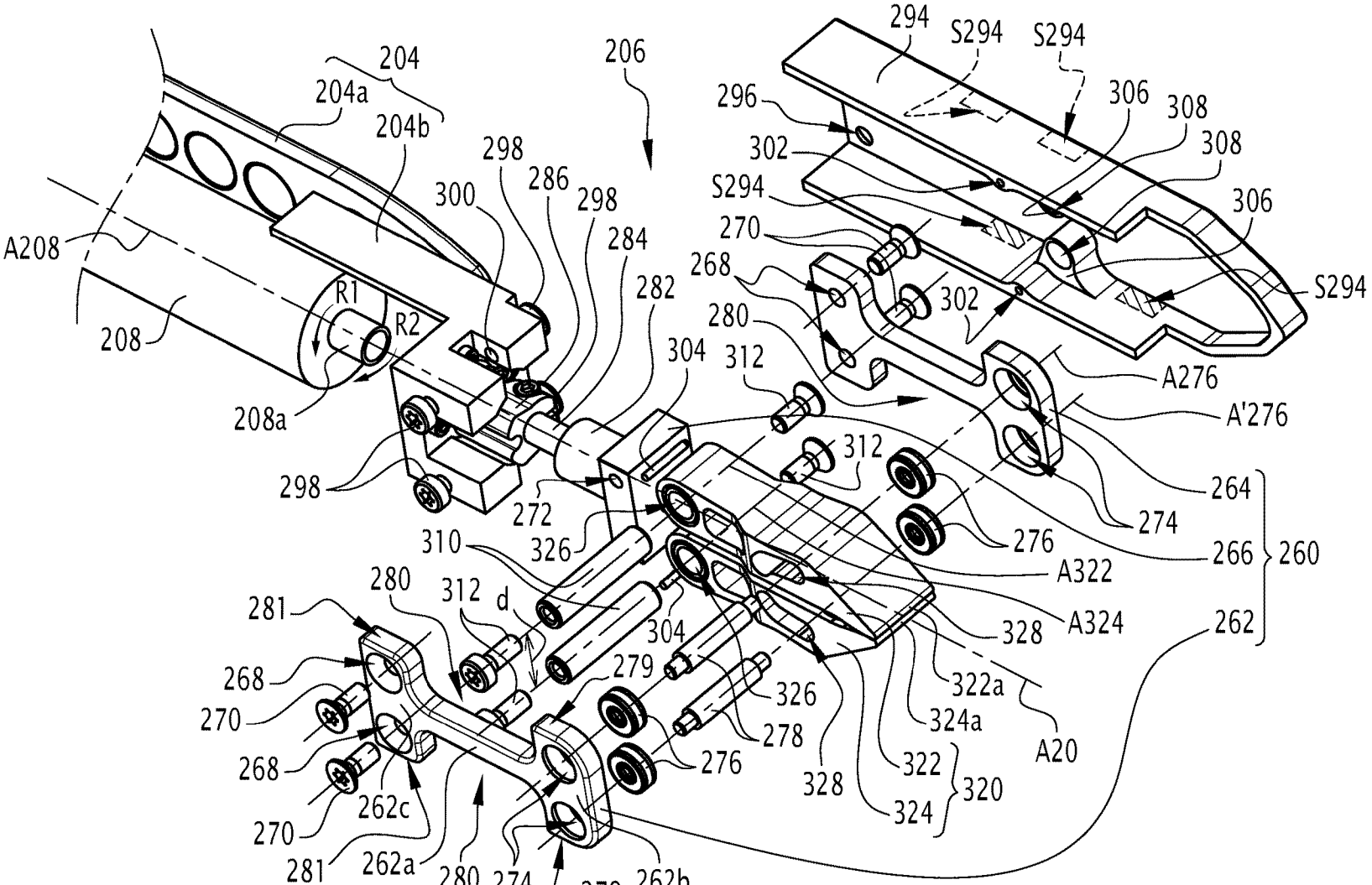
FIG. 5 is a partial perspective exploded view of the rapier head.

As visible on FIG. 5, each cam shaft 278 has a central portion with a relatively large diameter and two ends of a reduced diameter, adapted for introduction of each of these ends in a central bore of a cam cylinder 276.

Plates 262 and 264 are identical. The plate 262 is described here below and its description also applies to the plate 264.

The plate 262 is shaped as a I, with a central bar 262*a* parallel to the axis A20 and two end bars 262*b* and 262*c* perpendicular to the central bar 262*a* and parallel to each other.

The rapier 20 is designed for picking-up a weft yarn 34 at a pick-up position P1 and drawing this weft yarn into the shed, in a movement ending at a withdrawn position P2 located on the other side of the shed, outside of the shed. The weft insertion path is defined along the drawing-in axis Y20, between these positions P1 and P2. The rapier 20 can release the weft yarn 34 at any release position P3 selected between positions P1 and P2 along the drawing-in axis Y20.

One defines a front side of the rapier 20 as the side of the rapier oriented towards a weft yarn 34 to be picked-up, when the rapier head moves from the withdrawn position P2 to the pick-up position P1 along the drawing-in axis Y20. In particular, the rapier head 206 is mounted on the front side of the rapier body 204, which is mounted on the front side of the rapier rod 202.

A rear side of the rapier is opposite to its front side.

With this definition, the end bar 262*b* is a front end bar and end bar 262*c* is a rear end bar for plate 262. Beveled holes 268 are drilled through the rear end bar 262*c* and cylindrical holes 274 are drilled through the front end bar 262*b*.

Between the front and rear end bars 262*b* and 262*c*, and on either side of the central bar 262*a*, the plate 262 defines two longitudinal notches 280 whose largest dimension is parallel to the longitudinal axis A20. This corresponds to the I-shape of the plate 262.

The nut 266 includes an internally threaded portion 282 which accommodates a threaded spindle 284. This spindle is made fast in rotation, around the rotation axis A208 and via a screwed collar 286, with the output shaft 208*a* of the servomotor 208. Owing to the screw and nut assembly formed by parts 282 and 284, the rotation output movement of the servomotor shaft 208*a*, around the axis A208, is transformed into a translational movement of the slider 260, along the longitudinal axis A20.

279 and 281 respectively denote the extremity surfaces of the front end bar 262*b* and the rear end bar 262*c*. These extremity surfaces are parallel to the longitudinal axis A20 and perpendicular to the longest dimension of each end bar 262*b* and 262*c*. In the configuration represented on the figures, these surfaces 279 and 281 form upper and lower surfaces of the end bars 262*b* and 262*c*.

On the other hand, the rapier head 206 includes a frame 290 formed of a first shell 292 and a second shell 294. For the sake of clarity, the shell 292 is omitted on FIGS. 4, 5 and 7 to 9.

The shells 292 and 294 are identical. Shell 294 is described hereafter and its description applies also to shell 292.

Shell 294 is made of a metallic material such as light aluminum and has a concave shape, with its concavity oriented towards the slider 260, so that the slider 260 and any part located between the two plates 262 and 264 can be housed within the frame formed of shells 292 and 294.

The shell 294 is provided with two rear holes 296 for the passage of two screws 298 engaged in corresponding threaded holes 300 of the adapter block 204*a*. This allows firmly attaching the shell 294 on the side of the adapter block 204*a* not visible on FIG. 5. Thus, the frame 290 and the adapter block 204 are fast with each other along the longitudinal axis A20.

The shell 294 is also provided with two blind holes 302 configured for accommodating each a part of a pin 304 also engaged in a similar blind hole of the shell 292. The two pins 304 engaged in the four blind holes 302 allow centering, with respect to each other, the two shells 292 and 294 of the frame 290.

The shell 294 also includes two internal bosses 306, each boss 306 defining a through hole 308 capable of accommodating an end of a cylindrical sleeve 310 which forms a plane bearing for a clamp-jaw, as explained here-below.

Each end of each sleeve 310 is internally threaded for accommodating an end of a bearing screw 302 inserted, within a respective through hole 308 drilled in a shell 292 or 294, from the outside of this shell. Thus, once the two shells are assembled together in order to constitute the frame 290, the two sleeves are firmly held and precisely located within the inside volume defined between the two walls of the two shells parallel to the plates 262 and 264.

As shown on FIG. 5, the shell 294 defines four guiding surfaces S294 parallel to the axis A20 and configured for receiving, in a sliding contact configuration, the lateral surfaces 279 and 281 of the plates 262 and 264. These four guiding surfaces S294 are provided on the inner side of the upper and lower walls of the shells. On FIG. 5, the surfaces S294 provided on the upper wall of the shell 294 are represented with dotted lines since they are visible through this upper wall.

The surfaces S294 are divided between front surfaces S294, configured for cooperating with the front lateral surfaces 279, and rear surfaces S294, configured for cooperating with the rear lateral surfaces 281 of the two plates 262 and 264. The contact of the metallic surfaces S294 with the two plates 262 and 264, made of PEEK, is improved in terms of smoothness and lifetime.

The notches 280 defined by the plates 262 and 264 accommodate the bosses 306 when the plates 262 and 264 are installed within the shells 292 and 294, next to their walls perpendicular to the guiding surfaces S294 and where the rear holes 296 are provided. Due to the notches, the bosses 306 do not hinder a to-and-fro movement of the plates 262 and 264 within the frame 290.

A pair of two jaws 322 and 324 together form a clamp 320 imbedded within the rapier head 306. In the configuration of the figures, jaw 322 can be identified as an upper jaw and jaw 324 can be identified as a lower jaw.

The upper jaw 322 is articulated around an axis A322 defined by the upper sleeve 310 held in position within the frame 290 via the upper through holes 308 of the two shells 292 and 294. Similarly, the lower jaw 324 is articulated around a lower axis A324 defined as the central axis of the lower sleeve 310 held in position within the frame 290 via the lower through holes 308.

In order to allow such a mounting of the jaws with a possibility of rotation around axes A322 and A324, each jaw 322 or 324 is provided, near its rear extremity, with a through hole 326.

On the other hand, each jaw 322 or 324 is provided with a cam groove 328 which accommodates one of the cam shafts 278. Thus, each cam shaft 278 forms a follower member engaged in a cam groove 328 of a jaw 322 or 324. Each cam shaft 278 forms a linear contact zone between the slider 260 and the groove 328 where it is inserted. Alternatively, a punctual contact could be formed between the slider 260 and the groove 328, but it is less advantageous.

The parts 260 to 328 allows articulating the two jaws 322 and 324 around the two axes A322 and A324 perpendicular to the longitudinal axis A20 of the rapier 20 and to control their position around these axes via the translational movement of the slider 260 along this longitudinal axis.

Actually, the parts 260 to 328 together form a movement transforming mechanism for transforming the output rotational movement of the output shaft 228*a* of the servomotor 208, around the rotation axis A208, into a relative movement between the two jaws 322 and 324. More precisely, the movement transforming mechanism 260-328 exerts, via the cam shafts 278, opposite forces on the first and second jaws 322 and 324, for pivoting the first and second jaws toward or away from each other, as can be derived from the comparison of FIGS. 8 and 9. The cam shafts 278 form an output member of the movement transforming mechanism to operate the first and second jaws 322 and 324 of the clamp 320 into their relative movement of opening or closing. Actually, the movement transforming mechanism 260-328 is configured to open the clamp 320, that is to operate the clamp from its closed configuration to its open configuration, when the output shaft 208*a* of the electric motor rotates in a first direction, shown by arrow R1 on FIG. 5, around the rotation axis A208. Conversely, the movement transforming mechanism is configured to close the clamp, that is to operate the clamp from its open configuration to its closed configuration, when the output shaft 208*a* of the electric motor rotates in a second direction, opposite to the first direction and shown by arrow R2 on FIG. 5, around the rotation axis A208.

322*a* denotes the front edge of the upper jaw 322. This front edge is rectilinear and parallel to axes A322 and A324, thus perpendicular to axis A20. Similarly, the front edge 324*a* of the lower jaw 324 is rectilinear, parallel to axes A322 and A324 and perpendicular to axis A20.

Because of the orientation of the two edges 322*a* and 324*a*, which are parallel to each other, and of the symmetrical shape of the two jaws 322 and 324 with respect to the longitudinal axis A20, it is possible to obtain a linear contact of these two edges with a weft yarn 34, on its upper and lower sides, which avoids damaging the weft yarn, or reduces the risks of damaging this yarn.

With this respect, a non-abrasive coating can be applied on these two edges 322*a* and 324*a* or the surfaces of the jaws can be sandblasted at the level of these edges. For instance, this coating may be copper, zinc, plastic or rubber.

The rapier unit 200 controls the oscillating movement of the rapier 20 along the drawing-in axis, with the rapier head 206 following the drawing-in path between the pick-up position P1, located next to a receiving basket 29 close to the weft selector 28, and the withdrawn position P2, located on the other side of the shed. The rapier 20 is guided through the shed by the rod 202 which floats over the warp yarns 18 of the shed. The clamp 320 located at the nose of the rapier 20, that is at the forward end of the rapier head 206, catches a weft yarn 34 from the weft selector 28 on one side of the loom and inserts the weft yarn into the shed by drawing it from the pick-up position to a predetermined position P3 for releasing the weft yarn. As mentioned here above, this predetermined position P3 can be located at any point along the drawing-in axis Y20, between positions P1 and P2. Once the weft yarn 34 has been released at position P3, the rapier 20 withdraws the rapier head 206 from the shed, by bringing it to the side of the loom opposite to items 28 and 29, in the withdrawn position P2.

Figure 6:
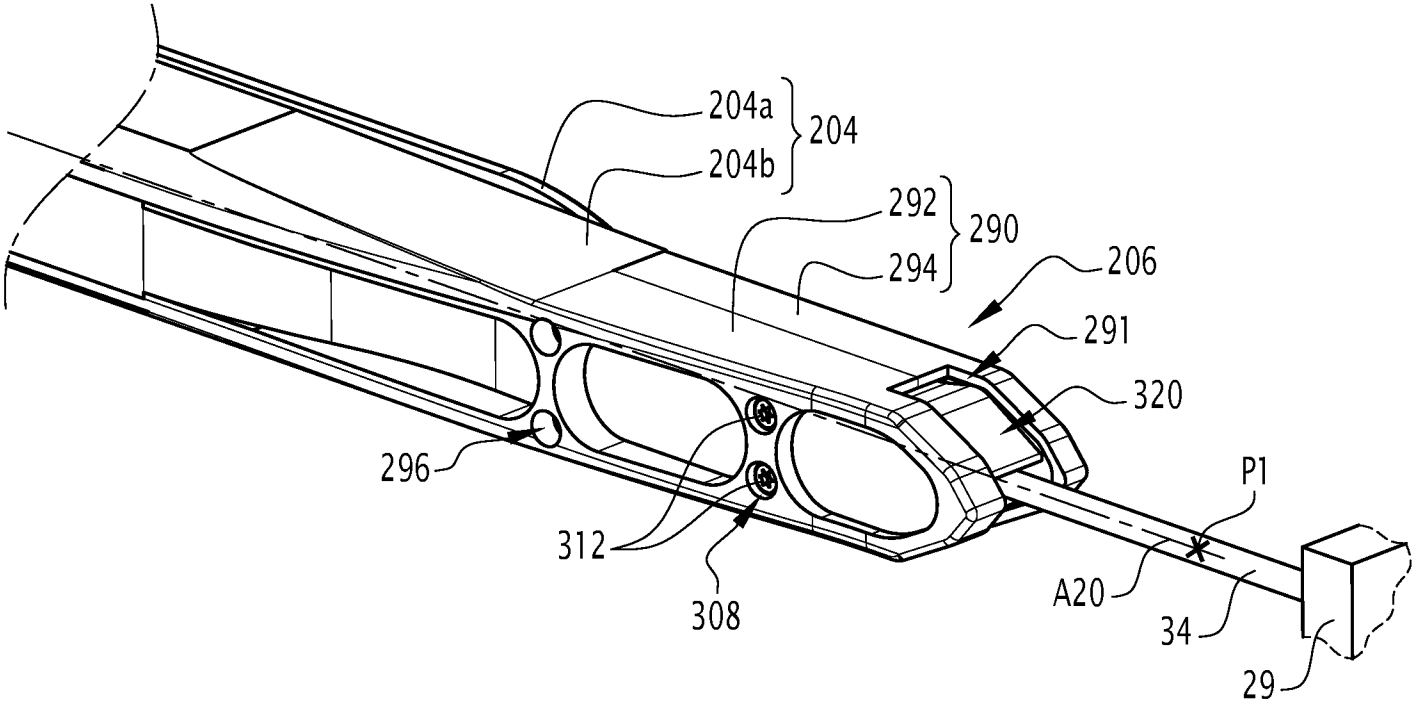
FIG. 6 is a perspective view of the rapier head interacting with a weft yarn.

As visible for instance on FIG. 6, the overall shape of the rapier head 206, as defined by the frame 290 is such that this rapier head 206 has a globally rectangular cross-section perpendicular to the longitudinal axis A20 and a beveled-shape at the level of its nose or forward end oriented towards the weft selector 28 and the basket 29. As visible on this FIG. 6, the clamp 320 can catch a weft yarn 34 through an opening 291 defined at the front end of the frame 290, between the two shells 292 and 294.

Each jaw 322 or 324 is provided with a lightening hole 329, which decreases its inertia in rotation around the corresponding axis A322 or A324.

In a direction perpendicular to axes A322, A324 and A20, axes A322 and A324 are separated by a distance d, vertical in this example, set between 5 and 15 mm, preferably equal to about 9 mm.

As visible on FIGS. 6 and 7 to 9, the front ends of the jaws 322 and 324 converge to the front towards the main longitudinal axis A20, so that they do not risk to interfere with the warp yarns 18 of the shed, when the rapier head moves forwardly from position P2 to position P1. Moreover the clamp 320 can be kept closed so that this risk is reduced.

Since each jaw 322 or 324 is precisely guided by a plain bearing formed by the cooperation of its through hole 326 and the corresponding sleeve 310, over its full width measured parallel to axes A322 or A324, the rotational and linear clearance between a jaw and its environment can be reduced. The parallelism and the accuracy of the contact line between the edges 322*a* and 322*b* and the weft is precisely defined, which is important for catching thin weft yarns and thin bands such as 3K, 6K or 12K weft yarns.

In particular, the clamp 320 is particularly adapted for catching wefts yarn in the form of bands, tapes or ribbons with a rectangular, closely rectangular, round or oval cross-section having a width between 0.014 mm and 2 cm and a thickness between 0.014 mm and 5 mm. These ranges are not limiting.

The bi-directional linear motion of the slider 260 along the longitudinal axis A20 of the rapier is transformed by the cooperation of the cam shafts 278 and the cam grooves 328 into a bi-directional non-linear motion which, in this example, is a rotation around the axes A322 and A324 of the sleeves 310.

More particularly, the shape of the cam grooves 328 defines the amplitude and the speed of the rotational movement of the jaws 322 and 324.

Figure 8:
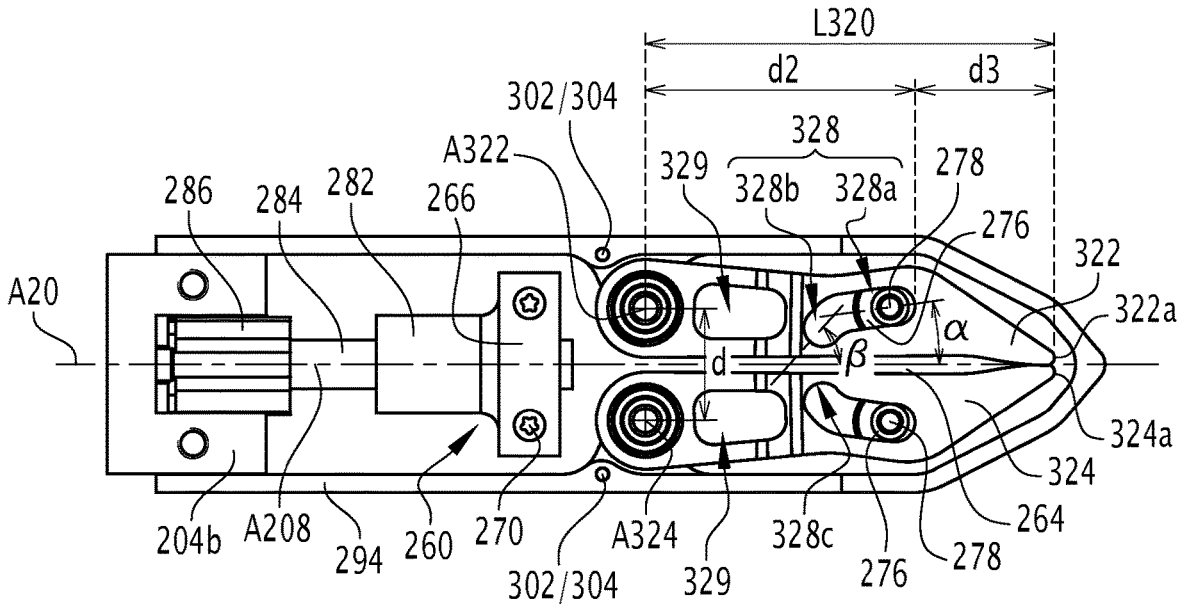
FIG. 8 is a side view of a part of the rapier head with the clamp in closed configuration.
Figure 9:
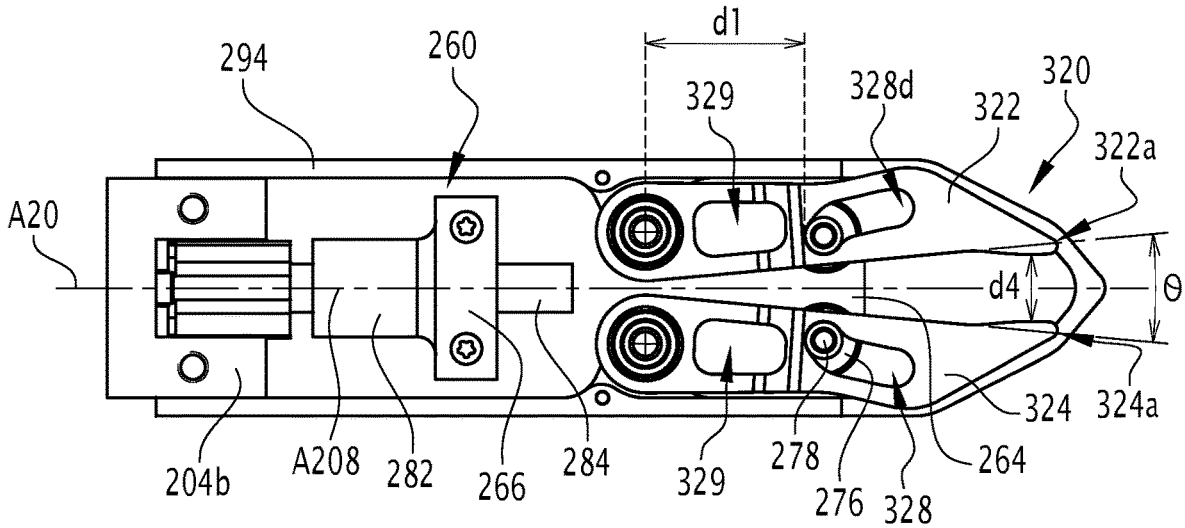
FIG. 9 is a side view similar to FIG. 8 with the clamp in open configuration

As more clearly visible for the groove 328 of the upper jaw 322 on FIG. 8, this groove has the shape of a hook with two straight branches, namely a front branch 328*a* and a rear branch 328*b*, both converging rearwardly towards the main longitudinal axis A20. The rear branch 328*b* converges more quickly towards the longitudinal axis A20 than the front branch 328*a*. α denotes an angle between a center line of the front branch 328*a* and the main longitudinal axis A20 and β denotes an angle between a center line of the rear branch 328*b* and the same axis A20. Angle β is larger than angle α, which means that the rear branch 328*b* is more inclined or steep with respect to axis A20 than the front branch 328*a*. The geometric shape of the branches 328*a* and 328*b* determines the stroke, the dynamics of the jaws movement and the intensity of the force applied to the weft yarn by the clamp 320. Through a sub-phase of cooperation of the follower member 278 with the branch 328*a*, the opening or closing movement are slow, as compared to the sub-phase of cooperation of the follower member with the branch 328*b*.

The diameter of the main part of each cam shaft or follower member 278 is chosen as close as possible to the transverse dimension of the cam groove 328, measured perpendicularly to the plane of FIG. 8 and to the center lines of the branches 328*a* and 328*b*. This limits the clearance between the cam shaft 278 and the cam groove 328. In practice, this clearance is of a few tenth of millimeters, so that driving of the jaws 322 and 324 around the axis A322 and A324 is accurate and the dynamic response of the clamp 320 is quick. Moreover, a coating can be applied on these cam grooves 328 to optimize the rolling of the cam shaft and the lifespan of the mechanism. For instance, this coating may be copper or zinc.

328*c* defines a rearward end of a cam groove 328, closer to the corresponding pivot axis A322 or A324 than the rest of the cam groove. The follower member formed by the cam shaft 278 is located in this rearward end when the clamp 320 is in its open configuration represented on FIG. 9. Similarly, 328*d* denotes a forward end of a cam grove 328, where the corresponding follower member or cam shaft 278 is located when the clamp 320 is in its closed configuration represented on FIG. 8.

L320 denotes the length of a jaw 322 or 324 measured, parallel to the longitudinal axis A20, between its pivot axis A322 or A324 and its forward edge 322*a* or 324*a*, when the clamp is in the closed position of FIG. 8. d1 denotes a distance measured parallel to the longitudinal axis A20 between the pivot axis A322 or A324 of a jaw and the rearward end 328*c* of the corresponding cam groove 328. The ratio d1/L320 is comprised between 0.4 and 0.6, preferably equal to about 0.5. d2 denotes a distance measured parallel to the longitudinal axis A20 between a pivot axis A322 or A324 and the forward end 328*d* of the corresponding cam groove 328. The ratio d2/L320 is comprised between 0.65 and 0.85, preferably equal to about 0.75. In other words, a distance d3 measured between the forward end 328*d* and the front edge 322*a* or 324*a* of a jaw 322 or 324 is equal to less than 35%, preferably about 25%, of the length L320. The following equation prevails:

$$d3/L320 \leq 0.35 \quad \text{(Equation 1)}$$

The position encoder 210 can be incremental. It can include a disc, fixed in rotation with a rotor of the servomotor 208, this disc being provided with an angular division used as a scale. On the other hand, because of the accuracy and reversibility of the movement transmission between the output shaft 208*a*, on the one hand, and the jaws 322 and 324, on the other hand, the angular position of the rotor of the servomotor 208, which is detected by the position encoder 210, can be considered as a geometric parameter representative of the angular position of the clamp, in particular as a geometric parameter representative of the angular position of the jaws 322 and 324 respectively around their pivot axes A322 and A324. This allows estimating, after calibration, and considering the profile of the groove 328, a distance d4 measured parallel to distance d, between the jaw edges 322*a* and 324*a*.

The embedded ECU 207 performs a closed loop control, as it is known in control electronics. This control unit receives a set point signal from the main ECU 82 and compares it with the current position of the motor shaft 208*a*, as provided by the position encoder 210. The embedded ECU 207 is then capable of determining a possible position offset and reducing it by sending a corresponding order to the servomotor 208.

Thus, it is possible to accurately control the opening range of the clamp 320, in particular in view of the shape and of the material of the weft yarn 34 to be caught at the pick-up position P1.

Similarly, the positon encoder 210 allows knowing the speed of movement of the jaws with respect to one another, this speed being also controlled by the embedded ECU 207 performing a closed loop control.

The rapier clamp 320 can also be controlled on the basis of the torque delivered by the electric motor 8. After calibration, the torque sensed by the torque sensor 212 is representative of the clamping force exerted by the jaws 322 and 324 when they pinch a weft yarn. The sensed torque can be set and compared to a set point value. Moreover, the sensed torque can be compared to a limit value, not to be overpassed, in order not to damage the weft yarn upon clamping.

Considering that the weft yarn can change between two successive picks during a weaving process implemented on the weaving loom 2, the set point parameters in terms of position, speed of displacement and/or torque applied to the servomotor 208 by the ECU 207, can be adapted between two successive picks, as a function of a parameter dependent on the weft yarn properties, such as its cross section, its shape, its thickness or its material. This control of the applied torque and/or position/speed results in controlling the clamping force exerted by the clamp. For the pick-by-pick adaptation of the clamping force, one can also take into account an external parameter such as the number of picks per minute, the temperature or humidity in the workshop or a parameter manually set by the weaver.

When one implements a weaving method according to the invention on the weaving loom 2, one can use the approach developed in EP-A-3 121 317 for distributing the weft yarns into the fabric. However, this is not compulsory and the weaving loom of the invention allows different weaving approaches, while using the rapier 20 of the invention.

For each pick, the memory 84 stores the weft parameters, such as the weft yarn type, the weft thickness, the weft yarn length, the weft yarn width, the weft yarn position along the drawing-in axis, the weft yarn friction coefficient with the jaws, etc.

The main ECU 82 determines a value or a range of values for the clamping parameters of the rapier head 206, as a function of the rapier position along the drawing-in axis Y20 and/or as function of the weaving cycle. This value can be

- the angular position of the jaws 322 and 324 when the clamp closes on the weft yarn at the pick-up position P1
- the angular position of the jaws while the rapier head draws the weft yarn 34 into the shed, between positions P1 and P3,
- the angular position of the jaws when the rapier head reaches the release position P3,
- etc.

The embedded ECU 207 controls successive operations of the servomotor 208 in coordination with the main ECU 82 which controls, amongst others, the drive 203 for moving the rapier 20 along the drawing-in axis Y20 and the Jacquard machine 6 for forming the shed set by the program P selected for weaving. The control units 82 and 207 continuously exchange information via data line or bus 226. Furthermore, the ECU 207 can optionally communicate with a library to store data and analyze the data during the weaving process, build statistics, and identify any deviation.

Figure 10:
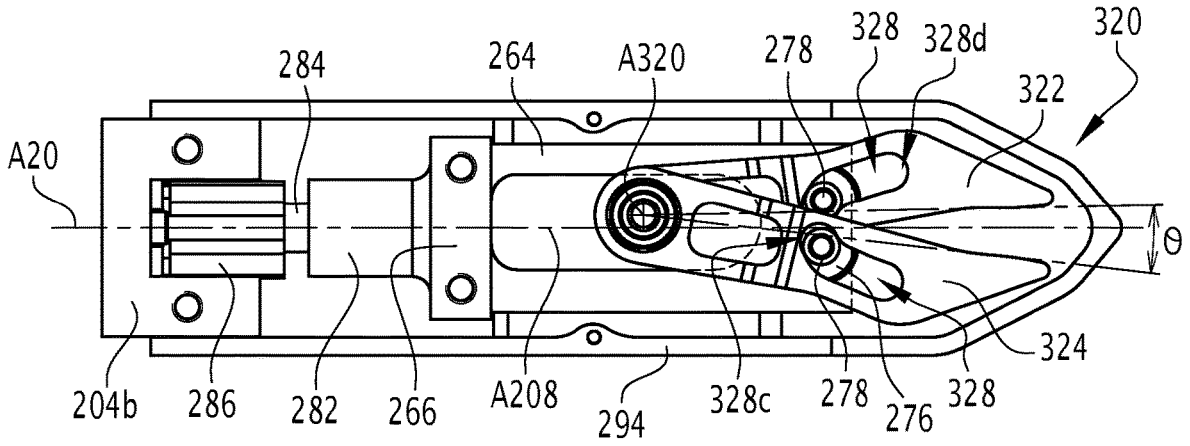
FIG. 10 is a side view similar to FIG. 9, for a rapier according to a second embodiment of the invention

In the second embodiment of the invention represented on FIG. 10, the elements of the rapier similar to the ones of the first embodiment bear the same references and work in the same way. Here after, only the differences with respect to the first embodiment are detailed.

In this second embodiment, the two jaws 322 and 324 of the clamp are articulated on a common axis A320 with respect to the rapier head frame represented by the shell 294. In this embodiment, the common axis A320 plays the role of axes A322 and A324 of the first embodiment, which are superimposed here. The two jaws are not guided over the full width of their plain bearing along axis A320, but each jaw is guided by one half of the plain bearing, which is common to the two jaws in this embodiment.

As in the first embodiment, the cam shafts 278 are moved parallel to the longitudinal axis A20 and engaged in the cam grooves 328, which allows piloting the pivoting movement of the jaws 322 and 324 around the common axis A320.

Figure 11:
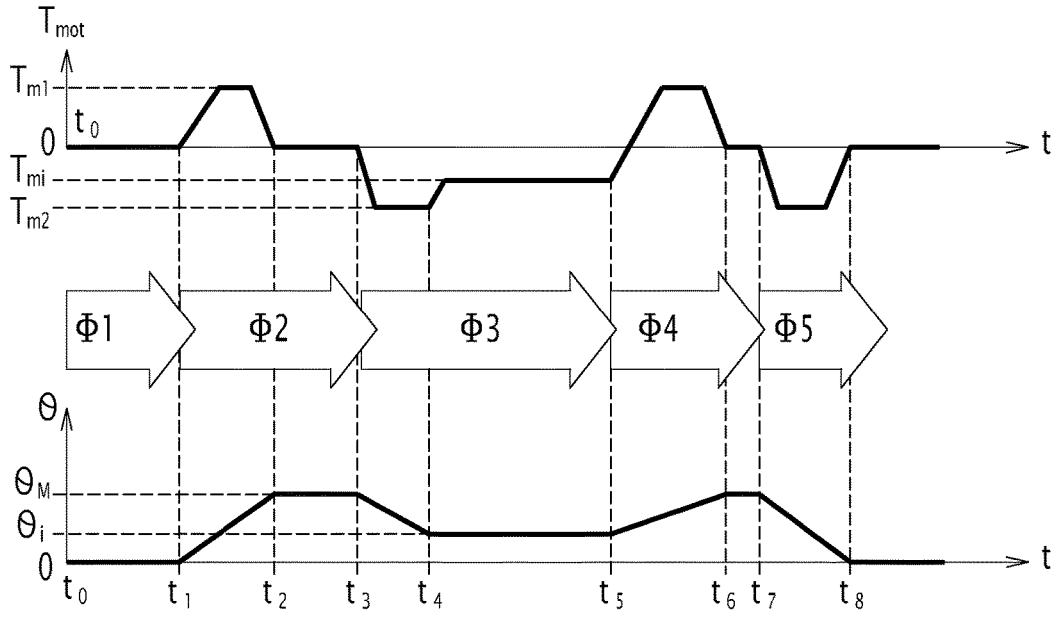
FIG. 11 is a schematic representation of a weaving method of the invention, showing the evolution over time of an opening angle of the clamp and of a torque applied by an electric motor.

In the representation of FIG. 11, which applies to both embodiments, one assumes that the movement of the rapier, for moving its head 206 from the withdrawal position P2 to the pick-up position P1, starts at an instant $t_0$. During a first phase Φ1, the rapier 20 moves along the drawing-in axis in the forward direction, towards the pick-up position P1. The clamp 320 remains closed in order not to interfere with the shed and the opening angle θ of the jaws 322 and 324 is set to zero. The value of the opening angle θ is set to zero in the configuration of FIG. 8. No torque is applied by the servomotor 208. In other words, the motor torque $T_{mot}$ equals zero.

When the rapier head is, at an instant $t_1$, about to reach the pick-up position P1, the jaws start opening until the opening angle θ of the clamp 320 reaches a given maximum value $\theta_M$, which occurs at an instant t2, when the rapier is at the pick-up position P1. Between instants $t_1$ and $t_2$, the torque applied by the motor quickly increases, then keeps a constant value $T_{m1}$, then decreases back to zero. When the jaws are in the fully open position, between instants t2 and t3, no torque is applied by the electric motor 208. Opening of the jaws occurs in a second phase Φ2 between instants t1 and t3.

At an instant t3, a third phase Φ3 starts, where the clamp 20 catches the weft yarn 34. For this, the opening angle θ between the jaws 322 and 324 is reduced to an intermediate value $\theta_i$, which is reached at an instant $t_4$. In order to decrease the angle θ, from the value $\theta_M$ to the value $\theta_i$, the torque applied by the servomotor 208 becomes negative between instants $t_3$ and $t_4$ and takes a second value $T_{m2}$. By negative, one means that the torque $T_{m2}$ is applied in a direction opposite to the torque $T_{m1}$. In other words, the servomotor 208 reciprocally actuates the clamp 20 by rotating in one direction and the opposite direction, as shown by arrows R1 and R2. At an instant $t_4$, the clamp is closed around the weft yarn 34, with the angle θ equal to the value $\theta_i$ strictly superior to zero, in order not to cut or harm the weft yarn. The value of angle $\theta_i$ is one of the set parameters provided by the embedded ECU 207 to the electric motor 208 and controlled via the encoder 210. Starting from instant t4 and up to another instant $t_5$, the angle θ is kept at the value $\theta_i$ and the torque applied by the servomotor 208 is kept at an intermediate value $T_{mi}$ between zero and the highest absolute value $T_{m2}$ applied between instants $t_3$ and $t_4$. This non-zero torque $T_{mi}$ is necessary for keeping the weft yarn 34 pinched between the jaw edges 322*a* and 324*a* during the drawing-in movement between positions P1 and P3. During this drawing-in movement, the clamp 320 must overcome the friction forces of the weft yarn 34 in devices 28 and 30, which tend to hold back the weft in the direction opposite to the drawing-in direction.

At the instant $t_5$, the rapier 20 starts opening the clamp 320 so that the angle θ takes back the maximum value $\theta_M$ at an instant $t_6$ up to an instant $t_7$. In this fourth phase Φ4 which takes place between instants t5 and t7, the weft yarn 34 is released in the released position P3 and the servomotor 208 applies the torque $T_{mi}$ in the same direction as between instant $t_1$ and $t_2$, in order to open the clamp. Between instants $t_6$ and $t_7$, the clamp 320 is kept open, the angle θ does not vary and no torque is applied.

In the fifth phase Φ5, which starts at instant $t_7$ and ends up at instant $t_8$, the clamp is closed again, by bringing the value of angle θ to zero, which is obtained by exerting a torque in the same direction as between instants $t_3$ and $t_4$. Then, the torque and the angle θ remain constant up to when the rapier reaches the withdrawn position P2, where the process starts again For instance, a geometric parameter representative of the opening of the clamp 320, namely of the angle θ, is measured through the electric motor during at least the third phase Φ3, assuming that the angular orientation of the output shaft 208*a* around axis A208 is representative of angle θ. Thus, if the angle θ decrease between $t_4$ and $t_5$, above a given limit, e.g. 20%, under the action of the torque $T_{mi}$, one can assume that the weft yarn has been lost by the rapier between positions P1 and P3.

Actually, the geometric parameter representative of the opening of the clamp 320, is measured through the electric motor at least during the fifth Φphase 5, when the clamp is moved back toward its closed configuration by reducing the angle θ from the value $\theta_M$ to the value zero. This allows checking that the weft yarn has been correctly released at the position P3.

In particular, it is possible to compare the angle θ measured during phase Φ3 to the angle θ measured during phase Φ5, which allows checking that the phase Φ4 has been correctly implemented, at the right position P3 along the drawing in axis Y20. In particular, it is determined if these values are equal or different. By equal, one means that these values differ by less that 5%. If these values are different, the process is considered to be normally operating. If these values are equal, the process is considered to be defective and an alarm is triggered.

It is also possible to compare the value of the angle θ measured during phase Φ5 to a threshold value $\theta_T$ which is previously preset. The previously preset threshold value $\theta_T$ can be determined in function of the thickness of the weft yarn, which can be provided manually or by the program P. Alternatively, the previously preset threshold value $\theta_T$ can be determined through a calibration step implemented with the current weft yarn at the beginning of the weaving process.

During the comparison step between the value of the angle θ measured during phase Φ5 and the threshold value $\theta_T$, it is determined if these values are equal or not. By equal, one means that these values differ by less that 5%. If these values are equal, the process is considered to be normally operating. If these values are different, the process is considered to be defective and an alarm is triggered.

In addition, a parameter representative of the clamping force applied by the clamp 320, namely the motor torque $T_{mot}$ delivered by the motor 208, is measured through the torque sensor 212 during at least the third phase Φ3 and the fifth phase Φ5, assuming that the motor torque $T_{mot}$ is representative of the clamping force.

The value of the motor torque $T_{mot}$ measured between instants $t_4$ and $t_5$ is compared to a first preset threshold value $T_T$, which is equal to $T_{mi}$. This threshold value $T_T$ can also be determined in function of the thickness of the weft yarn, which can be provided manually or by the program P. Alternatively, the preset threshold value TT can be determined through a calibration step implemented with the current weft yarn at the beginning of the weaving process.

Similarly, the motor torque $T_{mot}$ measured at instant $t_8$ is compared to a second preset threshold value $T_T$, which is equal to 0.

In addition, it is also possible to compare two values of the motor torque measured during two different steps of the drawing-in method.

During the comparison step between the value of the motor torque $T_{mot}$ measured during phases Φ3 and Φ5 and the threshold value $T_T$, it is determined if these values are equal or not. By equal, one means that these values differ by less that 5%. If these values are equal, the process is considered to be normally operating. If these values are different, the process is considered to be defective and an alarm is triggered.

In addition, it is also possible to compare two values of the motor torque measured during two different steps of the drawing-in method.

When a threshold value $\theta_T$ or $T_T$ is used, it is stored within the main ECU 82 of the weaving loom. The measured geometric parameter representative of the opening of the clamp or the measured parameter representative of the clamping force is stored within the main ECU 82, in particular in the memory 84.

Preferably, the comparison between the measured parameter θ or $T_{mot}$ with the corresponding threshold value $\theta_T$ or $T_T$ occurs within the main ECU 82. Similarly, the comparison between the values of the parameter θ or $T_{mot}$ measured at two different steps also occurs in the main ECU 82, so as to detect an abnormal gap. The main ECU 82 triggers a signal if the result of comparison satisfies a criterion for stopping the weaving loom.

In alternative, the embedded controller ECU 207 of the rapier 20 stores the successive measured values, the different threshold values, compares the successive values between them or with the threshold values and/or triggers a signal if the result of comparison satisfies a criterion for stopping the weaving loom.

Preferably, as explained here above, the parameter representative of the clamping force, i.e. is the motor torque $T_{mot}$, is measured via a physical value, preferably an instantaneous value of the current through the electric motor 208, which is proportional to the torque applied by the servomotor to the clamp.

Moreover, the opening of clamp and/or the torque delivered by the servomotor can be monitored and/or stored during several picks so that the deviation of the process can be controlled and a historical table of data is built and stored in a local file. For instance, monitoring the opening of the clamp 320 and/or torque delivered by the servomotor 208 also allows monitoring the building-up of debris, such as dust in the rapier head 206, monitoring the wear of the clamp 320, which allows detecting a drift of the system and scheduling appropriate maintenance operations.

The angular position of the rotor, the torque applied and the timing within a pick are partly or fully adapted considering the current weft yarn to draw-in and release within the shed, and according to the selected program P. Moreover, several modifications can be brought to the rapier, the loom and the method of the invention, as summarized here below.

The succession of phases Φ1 to Φ5 shows that the servomotor 208 and the associated movement transforming mechanism 260 to 312 allow precisely controlling the clamp 320 and even detecting an undesired situation by controlling the angular position of the rotor of the servomotor 208 and/or the torque applied by this servomotor. An undesired situation is detected when the result of measuring the angular position of the rotor and/or the torque applied by the servomotor has not reached a threshold value which is set before the weaving operations, or which is preferably set by measuring the angular position of the rotor and/or the torque applied by the servomotor in a previous step. The undesired situation is detected when the results of measuring the angular position of the rotor and/or the torque applied by the servomotor do not vary in more than a given relative limit.

Furthermore, measuring the opening of clamp 320, corresponding to the angle θ, and/or the torque $T_{mot}$ delivered by the servomotor 208 occurs at different steps of drawing-in the weft yarn, so as to verify that a step or different steps of the pick are correctly implemented.

According to a non-represented embodiment of the invention, one of the jaws of the clamp can be stationary, the other jaw being piloted with a slider, as explained here-above for the two jaws of the first and second embodiments. As an alternative, the jaws can be asymmetrical.

The design of the slider can be different from the one represented on the figures and another type of mechanical members could be used to convert the translational motion of the slider into the angular motion of the jaw(s).

Inside of the rotary bearings formed by sleeves 310 in holes 326, other types of bearings can be considered, in particular high precision linear bearings.

As an alternative, the plates 262 and 264 could be made in one piece with the nut 266. In such a case, the linear arms of the nut, used instead of the plates 262 and 264, can have extensions, oriented toward the longitudinal axis A20, configured for interacting with the cam grooves 328 of the jaws 322 and 324. In such a case, it is not necessary to use cam shafts as in the first two embodiments and the follower members are formed by these extensions.

Instead of having cam shafts mounted on the plates and cam grooves drilled in the jaws, one could use cam grooves on the plates and cam shafts on the jaws.

The structure of the movement transforming mechanism can be different from the one represented on the figures. For instance, the motion transforming mechanism can extend on one side only of the longitudinal axis. In other words, there could be only one plate 262 or 264.

The follower member formed by the cam shaft 268 in the example can take another form, such as a cylinder, a pin, a cam or a roller.

In an alternative embodiment, the jaws can move in translation with respect to one another, instead of in rotation.

The rotary encoder 210 can be optical, magnetic or mechanical. In an alternative, the rotary encoder 210 can also be an absolute encoder, even if it is relatively bulky.

Instead of using a remote power source 224 and a remote control unit 82, all these items can be embedded in the rapier, together with the control unit 207 and servomotor 208, so that the rapier can be fully autonomous within the shed.

The rapier can include an embedded energy storage capacitor. Such a capacitor can be loaded during the movement of the rapier, or at specific locations, or by converting motion energy, light or temperature into electric power.

Instead of a data communication made via electric lines or buses, the communication of data could be made wirelessly.

According to a non-represented option of the invention, the servomotor 208 can be electrically isolated from the rapier body 204, in order to avoid problems of electrostatism.

Instead of a brushless DC servomotor, the electric motor 208 can be a traditional DC motor or an AC motor.

Different controlling options and control architecture can be implemented with the invention. For instance, in an alternative, the ECU 207 can be out of the rapier head, in particular remote in the weaving loom.

The invention is compatible with the use of two superposed active rapiers.

The invention can also be used in a taker rapier, which cooperates with a giver rapier and to a giver rapier which cooperates with a taker rapier.

The jaws, in particular their edges 322*a* and 324*a*, can have their surfaces coated with rubber, aluminum or steel. Alternatively or in addition, these edges are arched or inclined.

The cam grooves 328 can be located in front of the rotation axis of the cam, like cam grooves 328 with respect to axes A320, A322 and A324 on the example of the figures, but the cam grooves and associated cam shafts could also be located of the rear side of these axes.

An alternative geometric definition of the cam groove allows changing the stroke, the dynamics of the jaws movement and the intensity of the force applied to the weft yarn by the clamp.

The invention also applies to a rapier head with magnetic guiding means cooperating with the reed 23 of the weaving loom 2, as disclosed in EP-A-2 829 646.

Irrespective of the embodiment and variants considered here-above, the invention makes use of a servo-driven clamp 320 and provides at least the following benefits:

- It allows reaching any arbitrary position of the clamp with an arbitrary speed and torque, in the limit of the output capacities of the electric motor.
- Different closed positions can be defined for catching different weft yarns.
- It allows reaching any angular position for clamping the yarn.
- It allows fixing the angular position for clamping, adapting the clamping force of the jaws, on the basis of the weft material and from one pick to another.
- It provides two parallel clamping edges to efficiently catch the weft yarn.
- It allows adapting the closing movement of the jaws, by adapting the torque delivered by the servo-motor, while taking into account the friction of the weft yarn travelling in the shed.
- It allows adapting the closing movement and the position of the jaws depending on the conditions of the tensioning/braking of the weft yarn in the weft selector or in any feeding device.
- It allows checking the presence of the weft material at the pick-up position by measuring the torque delivered by the servo-motor in the vicinity of this position.
- It allows checking the thickness/yarn count of the weft yarn by detecting the angular position of the jaw when leaving the pick-up position.
- It allows checking that the yarn is not lost between the pick-up position and the release position, for instance by verifying that the torque applied in phase $\Phi 3$ does not vary by more than 20% between instant $t_4$ and $t_5$.
- It allows checking that the weft yarn has been correctly released at the released position P3 by successive opening/closing movements of the jaws and by checking that the closed position corresponds to the zero value of the angle $\theta$.
- It also allows determining if the clamp is empty or not by implementing small movements along the set position of the jaws for a given signal of the weft yarn. If the clamp is not empty, the sensed position will remain within a given range around the set position.
- It allows determining the length of an unwinding weft yarn. As soon as the clamp is empty, the successful release can be detected by the control unit 207. With information on the cutting time, drawing-in time and speed of the rapier, the controller concatenates the available data to determine the length of weft yarn which has been caught, drawn, cut and released into the shed.
- It allows checking the weft position in small and non-accessible sheds.
- One does not need to rely on a spring to close the clamp. Its movements are accurately controlled.

The embodiments and alternative embodiments considered here-above can be combined, in order to generate new embodiments of the invention, in the framework of the appended set of claims.

The invention claimed is:

1. A rapier for drawing-in a weft yarn from a pick-up position into a shed of a weaving loom, along a drawing-in path, the rapier including

- a rapier head mounted at one end of the rapier, said rapier head extending along a main longitudinal axis of the rapier and being driven, along the drawing-in path, by a drive;
- a clamp for catching a weft yarn, said clamp being mounted in the rapier head and being operable between an open configuration and a closed configuration;
- an actuator mounted on the rapier for actuating the clamp; and
- a movement transforming mechanism for transforming an output movement of the actuator into an opening or a closing movement of the clamp, wherein the actuator is an electric motor and wherein an output shaft of the motor rotates around a rotation axis parallel to the main longitudinal axis of the rapier, wherein the movement transforming mechanism is configured to operate the clamp from its closed configuration to its open configuration when the output shaft of the electric motor rotates in a first direction around the rotation axis and to operate the clamp from its open configuration to its closed configuration when the output shaft of the electric motor rotates is a second direction, opposite to the first direction, around the rotation axis, wherein the movement transforming mechanism includes a slider movable in translation along a direction parallel to the main longitudinal axis, between a first longitudinal position and a second longitudinal position, said slider being configured to operate the clamp from its closed configuration to its open configuration when the slider moves from its first longitudinal position to its second longitudinal position and to operate the clamp from its open configuration to its closed configuration when the slider moves from its second longitudinal position to its first longitudinal position, and wherein the slider is equipped with a nut, integral or fixed in rotation with the slider, and the electric motor is equipped with a threaded rod engaged in the nut; or the electric motor is equipped with a nut, integral or fixed in rotation with the electric motor, and the slider is equipped with a threaded rod engaged in the nut, so that the rotation movement of an output shaft of the electric motor is converted into a translation movement of the slider.

2. The rapier of claim 1, wherein the slider includes a set of two plates which extend parallel to the main longitudinal axis, on two lateral sides of this axis, each plate including first and second sliding surfaces, separated from each other along the main longitudinal axis and configured to slide along corresponding guiding surfaces provided on a frame of the rapier head.

3. The rapier of claim 1, wherein the clamp includes two jaws, with at least a first jaw articulated with respect to a frame of the rapier head, around a pivot axis perpendicular to the main longitudinal axis, wherein the first jaw extends, along the longitudinal axis at least between the pivot axis and a jaw-end configured to catch, in cooperation with the other jaw of the clamp, a weft yarn to be drawn into the shed.

4. The rapier of claim 1, wherein the clamp includes a first jaw articulated with respect to the frame of the rapier head, around a first pivot axis perpendicular to the main longitudinal axis, and a second jaw articulated with respect to the frame of the rapier head, around a second pivot axis perpendicular to the main longitudinal axis and wherein the first and second pivot axes are parallel and/or superimposed.

5. The rapier of claim 4, wherein the first and second jaws extend symmetrically on either sides of the main longitudinal axis and the movement transforming mechanism exerts opposite forces on the first and second jaws, for pivoting the first and second jaws toward or away from each other with respect to the main longitudinal axis.

6. The rapier of claim 1, wherein the clamp includes two jaws, with at least a first jaw articulated with respect to a frame of the rapier head, around a pivot axis perpendicular to the main longitudinal axis, wherein the first jaw extends, along the longitudinal axis at least between the pivot axis and a jaw-end configured to catch, in cooperation with the other jaw of the clamp, a weft yarn to be drawn into the shed, the first jaw is provided with a groove and the slider is equipped with a follower member engaged in the groove of the first jaw, or the slider is provided with a groove and the first jaw is equipped with a follower member engaged in the groove of the slider; and the groove is configured for guiding the follower member engaged in the groove and configured for converting a translation movement of the slider parallel to the main longitudinal axis into a pivoting movement of the first jaw.

7. The rapier of claim 6, wherein the groove has a curved profile extending between a first end and a second end;

when the follower member is at the first end, the clamp is in its open configuration;

when the follower member is at the second end, the clamp is in its closed configuration; and the second end of the profile extends at a distance, measured parallel to the main longitudinal axis, equal to less than 35%, preferably about 25%, of a distance measured, along the main longitudinal axis, between the pivot axis and the jaw-end.

8. The rapier of claim 1, wherein it includes a position encoder, for measuring a geometric parameter representative to the opening of the clamp, and/or a torque controller for measuring a torque delivered by the electric motor.

9. A method for drawing-in a weft yarn into a shed on a weaving loom, said weaving loom comprising:

a warp delivery unit;

heddles for moving the warp yarns in order to form a shed;

a shed forming mechanism, which moves the heddles;

weft bobbins, which provide weft yarns to the loom; and a rapier for drawing-in a weft yarn from a pick-up position into the shed, along a drawing-in path, the method including at least the following steps consisting in:

a) catching the weft yarn at the pick-up position;

b) drawing the weft yarn into the shed, to a predetermined position along the drawing-in path;

c) releasing the weft yarn at the predetermined position; and d) withdrawing the rapier from the predetermined position out of the shed wherein the method is implemented with a rapier according to claim 1 and at least one of a geometric parameter representative of the opening of the clamp and a parameter representative of the clamping force, is measured during at least one of steps a), b) or d), and the value of the measured parameter is compared to a threshold value or two values of the parameter measured during two different steps are compared to each other.

10. The method of claim 9, wherein the geometric parameter representative of the opening of the clamp or the parameter representative of the clamping force is measured, respectively, through the electric motor as an angular position of an output shaft of the electric motor around the rotation axis, or as a physical value proportional to the torque applied by the electric motor to the clamp.

11. The method of claim 9, wherein the clamp is brought to its open configuration at step c);

during step d), sub-steps are implemented, which consists in d1)—operating the clamp from its open configuration to its closed configuration d2)—measuring the geometric parameter representative of the opening of the clamp in the closed configuration, and wherein the geometric parameter measured in at least one of steps a), b) or d) and compared to the threshold value is the geometric parameter measured at sub-step d2) or the two values of the geometric parameter measured during two different steps include the value measured at sub-step d2).

12. The method of claim 11, wherein a value of the geometric parameter representative of the opening of the clamp measured during step b) is compared to a value of the same geometric parameter measured during sub-step d1).

13. The method of claim 9, wherein the clamp includes two jaws, with at least a first jaw articulated with respect to a frame of the rapier head, around a pivot axis perpendicular to the main longitudinal axis, wherein the first jaw extends, along the longitudinal axis at least between the pivot axis and a jaw-end configured to catch, in cooperation with the other jaw of the clamp, a weft yarn to be drawn into the shed and wherein, preferably, the jaw-end is a clamping edge perpendicular to the main longitudinal axis and wherein a clamping force exerted by the clamp in its closed configuration or an angle between the two jaws of the clamp at the pickup position is adaptable between two successive picks, as a function of a parameter dependent on the weft yarn properties or as a function of an external parameter and wherein the clamping force or the opening of the clamp is measured through the electric motor during step a).

14. A weaving loom for weaving a fabric with warp yarns and in woven weft yarns, said weaving loom comprising:

a warp delivery unit;

heddles for moving the warp yarns in order to form a shed;

a shed forming mechanism, which moves the heddles;

weft bobbins, which provide weft yarns to the loom; and a rapier for drawing a weft yarn from a pick-up position into the shed, along a drawing-in path, wherein the rapier is according to claim 1 and includes an embedded control unit in communication with a main control unit of the weaving loom and wherein said embedded control unit controls the electric motor of the rapier on the basis of data provided by the main control unit of the weaving loom.

15. A rapier for drawing-in a weft yarn from a pick-up position into a shed of a weaving loom, along a drawing-in path, the rapier including a rapier head mounted at one end of the rapier, said rapier head extending along a main longitudinal axis of the rapier and being driven, along the drawing-in path, by a drive;

a clamp for catching a weft yarn, said clamp being mounted in the rapier head and being operable between an open configuration and a closed configuration;

an actuator mounted on the rapier for actuating the clamp; and a movement transforming mechanism for transforming an output movement of the actuator into an opening or a closing movement of the clamp, wherein the actuator is an electric motor, wherein an output shaft of the motor rotates around a rotation axis parallel to the main longitudinal axis of the rapier, wherein the movement transforming mechanism is configured to operate the clamp from the closed configuration to the open configuration when the output shaft of the electric motor rotates in a first direction around the rotation axis and to operate the clamp from the open configuration to the closed configuration when the output shaft of the electric motor rotates is a second direction, opposite to the first direction, around the rotation axis, wherein the movement transforming mechanism includes a slider movable in translation along a direction parallel to the main longitudinal axis, between a first longitudinal position and a second longitudinal position, said slider being configured to operate the clamp from the closed configuration to the open configuration when the slider moves from the first longitudinal position to the second longitudinal position and to operate the clamp from the open configuration to the closed configuration when the slider moves from the second longitudinal position to the first longitudinal position, and wherein the slider includes a set of two plates which extend parallel to the main longitudinal axis, on two lateral sides of this axis, each plate including first and second sliding surfaces, separated from each other along the main longitudinal axis and configured to slide along corresponding guiding surfaces provided on a frame of the rapier head.

16. The rapier of claim 15, wherein the clamp includes two jaws, with at least a first jaw articulated with respect to a frame of the rapier head, around a pivot axis perpendicular to the main longitudinal axis, wherein the first jaw extends, along the longitudinal axis at least between the pivot axis and a jaw-end configured to catch, in cooperation with the other jaw of the clamp, a weft yarn to be drawn into the shed, the first jaw is provided with a groove and the slider is equipped with a follower member engaged in the groove of the first jaw, or the slider is provided with a groove and the first jaw is equipped with a follower member engaged in the groove of the slider; and the groove is configured for guiding the follower member engaged in the groove and configured for converting a translation movement of the slider parallel to the main longitudinal axis into a pivoting movement of the first jaw.

17. The rapier of claim 16, wherein the groove has a curved profile extending between a first end and a second end;

when the follower member is at the first end, the clamp is in its open configuration;

when the follower member is at the second end, the clamp is in its closed configuration; and the second end of the profile extends at a distance, measured parallel to the main longitudinal axis, equal to less than 35%, preferably about 25%, of a distance measured, along the main longitudinal axis, between the pivot axis and the jaw-end.

18. The rapier of claim 15, wherein it includes a position encoder, for measuring a geometric parameter representative to the opening of the clamp, and/or a torque controller for measuring a torque delivered by the electric motor.

19. A method for drawing-in a weft yarn into a shed on a weaving loom, said weaving loom comprising:

a warp delivery unit;

heddles for moving the warp yarns in order to form a shed;

a shed forming mechanism, which moves the heddles;

weft bobbins, which provide weft yarns to the loom; and a rapier for drawing-in a weft yarn from a pick-up position into the shed, along a drawing-in path, the method including at least the following steps consisting in:

e) catching the weft yarn at the pick-up position;

f) drawing the weft yarn into the shed, to a predetermined position along the drawing-in path;

g) releasing the weft yarn at the predetermined position; and h) withdrawing the rapier from the predetermined position out of the shed wherein the method is implemented with a rapier according to claim 15 and at least one of a geometric parameter representative of the opening of the clamp and a parameter representative of the clamping force, is measured during at least one of steps a), b) or d), and the value of the measured parameter is compared to a threshold value or two values of the parameter measured during two different steps are compared to each other.

20. The method of claim 19, wherein the clamp includes two jaws, with at least a first jaw articulated with respect to a frame of the rapier head, around a pivot axis perpendicular to the main longitudinal axis, wherein the first jaw extends, along the longitudinal axis at least between the pivot axis and a jaw-end configured to catch, in cooperation with the other jaw of the clamp, a weft yarn to be drawn into the shed and wherein, preferably, the jaw-end is a clamping edge perpendicular to the main longitudinal axis and wherein a clamping force exerted by the clamp in its closed configuration or an angle between the two jaws of the clamp at the pickup position is adaptable between two successive picks, as a function of a parameter dependent on the weft yarn properties or as a function of an external parameter and wherein the clamping force or the opening of the clamp is measured through the electric motor during step a).

21. A weaving loom for weaving a fabric with warp yarns and in woven weft yarns, said weaving loom comprising:

a warp delivery unit;

heddles for moving the warp yarns in order to form a shed;

a shed forming mechanism, which moves the heddles;

weft bobbins, which provide weft yarns to the loom; and a rapier for drawing a weft yarn from a pick-up position into the shed, along a drawing-in path, wherein the rapier is according to claim 15 and includes an embedded control unit in communication with a main control unit of the weaving loom and wherein said embedded control unit controls the electric motor of the rapier on the basis of data provided by the main control unit of the weaving loom.

* * * * *